US010903025B1

(12) United States Patent
Tsai et al.

(10) Patent No.: US 10,903,025 B1
(45) Date of Patent: Jan. 26, 2021

(54) KEYBOARD WITH VIBRATION FUNCTION

(71) Applicant: Primax Electronics Ltd., Taipei (TW)

(72) Inventors: Sheng-An Tsai, Taipei (TW); Chun-Che Wu, Taipei (TW); Shu-Wei Chou, Taipei (TW); Chun-Nan Su, Taipei (TW); Tzu-Chiang Shih, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/800,650

(22) Filed: Feb. 25, 2020

(30) Foreign Application Priority Data

Dec. 13, 2019 (TW) ..... 108145806 A

(51) Int. Cl.
*H01H 13/85* (2006.01)
*H01H 13/86* (2006.01)
*H01H 13/7065* (2006.01)

(52) U.S. Cl.
CPC ..... *H01H 13/85* (2013.01); *H01H 13/7065* (2013.01); *H01H 13/86* (2013.01)

(58) Field of Classification Search
CPC .... H01H 13/85; H01H 13/7065; H01H 13/86; H01H 13/84
See application file for complete search history.

(56) References Cited

U.S. PATENT DOCUMENTS

2008/0131184 A1* 6/2008 Brown ..... G06F 3/0238 400/490
2015/0027869 A1* 1/2015 Smith ..... G08B 6/00 200/5 A

* cited by examiner

*Primary Examiner* — Anthony R Jimenez
*Assistant Examiner* — Lheiren Mae A Caroc
(74) *Attorney, Agent, or Firm* — Kirton McConkie; Evan R. Witt

(57) ABSTRACT

A keyboard with a vibration function is provided. The keyboard includes a base member, an upper cover, a basic key structure and a vibration key structure. The vibration key structure includes a control module, a vibration keycap and an isolation element. The control module is fixed on the upper cover. When the control module is triggered, a vibration key signal is generated and a vibration action is provided. The control module is covered by the vibration keycap. The vibration keycap is exposed outside the upper cover. The isolation element is arranged between the control module and the upper cover. The vibration key structure is enclosed by the isolation element, so that the energy of the vibration action from the control module is isolated.

10 Claims, 5 Drawing Sheets

KEYBOARD WITH VIBRATION FUNCTION

FIELD OF THE INVENTION

The present invention relates to a keyboard, and more particularly to a keyboard with a vibration function.

BACKGROUND OF THE INVENTION

Generally, the widely-used peripheral input device of a computer system includes for example a mouse, a keyboard, a trackball, or the like. For example, characters or symbols can be directly inputted into the computer system via the keyboard. As a consequence, most users and most manufacturers of input devices pay much attention to the development of keyboards.

Hereinafter, a key structure of a conventional keyboard will be illustrated with reference to FIG. 1. FIG. 1 is a schematic side cross-sectional view illustrating a conventional key structure. As shown in FIG. 1, the conventional key structure 1 comprises a keycap 11, a scissors-type connecting element 12, a rubbery elastomer 13, a membrane switch circuit member 14 and a base plate 15. The keycap 11, the scissors-type connecting element 12, the rubbery elastomer 13 and the membrane switch circuit member 14 are supported by the base plate 15. The scissors-type connecting element 12 is used for connecting the base plate 15 and the keycap 11. Consequently, the keycap 11 is movably fixed on the base plate 15.

The membrane switch circuit member 14 comprises plural key intersections (not shown). When one of the plural key intersections is triggered, a corresponding key signal is generated. The rubbery elastomer 13 is disposed on the membrane switch circuit member 14 and enclosed by the scissors-type connecting element 12. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The scissors-type connecting element 12 is arranged between the base plate 15 and the keycap 11, and the base plate 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base plate 15. Moreover, the first frame 121 comprises a first keycap post 1211 and a first base plate post 1212. The first frame 121 is connected with the keycap 11 through the first keycap post 1211. The first frame 121 is connected with the base plate 15 through the first base plate post 1212. The second frame 122 is combined with the first frame 121. A first end of the second frame 122 is connected with the base plate 15. A second end of the second frame 122 is connected with the keycap 11. Moreover, the second frame 122 comprises a second keycap post 1221 and a second base plate post 1222. The second frame 122 is connected with the keycap 11 through the second keycap post 1221. The second frame 122 is connected with the base plate 15 through the second base plate post 1222.

The operations of the conventional key structure 1 in response to the depressing action of the user will be illustrated as follows. Please refer to FIG. 1 again. When the keycap 11 is depressed, the keycap 11 is moved downwardly to push the scissors-type connecting element 12 in response to the depressing force. As the keycap 11 is moved downwardly relative to the base plate 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed. The structure and operation of the key structure of the conventional keyboard have been described as above.

Recently, a lot of electronic sports games have been introduced into the market and favored by the users. For example, First-person shooter (FPS) is an electronic sports game that provides the user with immersive gaming feel. However, during the process of playing the electronic sports game, the user needs to frequently click the key structure 1 to input a command. Because of the frequent operation, the conventional key structure 1 is readily damaged. For solving this problem, a keyboard with a mechanical key structure has been introduced into the market. Since the use life of the mechanical key structure is long, the keyboard with the mechanical key structure can meet the requirements of the users of the electronic sports games.

The structure of a mechanical key structure will be described as follows. FIG. 2 is a schematic side cross-sectional view illustrating a conventional mechanical key structure. As shown in FIG. 2, the mechanical key structure 2 comprises a keycap (not shown), a pedestal 21, an upper cover 22, a push element 23, a linkage element 24, a first spring strip 25, a second spring strip 26 and a circuit board (not shown). The pedestal 21 is covered by the upper cover 22. The upper cover 22 has an opening 221. The linkage element 24 is located at a middle region of the pedestal 21. Moreover, the linkage element 24 is movable upwardly or downwardly relative to the pedestal 21. The first spring strip 25 is partially disposed within the pedestal 21, and located near a sidewall of the pedestal 21. The second spring strip 26 is partially disposed within the pedestal 21, and arranged between the linkage element 24 and the first spring strip 25. The push element 23 and the linkage element 24 are collaboratively disposed on the pedestal 21. The push element 23 is penetrated through the opening 221 and coupled with the keycap. Moreover, the first spring strip 25 and the second spring strip 26 are electrically connected with the circuit board.

Please refer to FIG. 2 again. The linkage element 24 has a protrusion structure 241. The protrusion structure 241 is extended from a sidewall of the linkage element 24 toward the first spring strip 25. Moreover, the first spring strip 25 comprises a fixing part 251 and an elastic part 252. The fixing part 251 is fixed on the pedestal 21. The elastic part 252 is extended from the fixing part 251. Moreover, the elastic part 252 is contacted with the protrusion structure 241 of the linkage element 24. Consequently, the elastic part 252 is movable relative to the fixing part 251.

When the keycap is depressed, the keycap is moved downwardly to push the push element 23. Consequently, the linkage element 24 connected with the push element 23 is moved downwardly. As the linkage element 24 is moved downwardly, the protrusion structure 241 of the linkage element 24 is contacted with the elastic part 252 and moved downwardly along the elastic part 252. While the linkage element 24 is quickly moved in response to the depressing force of the user, the linkage element 24 is quickly moved across the elastic part 252, and the elastic part 252 is pushed by the protrusion structure 241 of the linkage element 24. Consequently, the elastic part 252 is moved relative to the fixing part 251 to collide with the second spring strip 26. Since the first spring strip 25 and the second spring strip 26 are contacted with each other, the circuit board outputs a corresponding key signal. Moreover, while the first spring strip 25 and the second spring strip 26 are contacted with each other, a click sound is generated. Due to the click sound, the user can feel the depressing feedback.

Although the conventional mechanical key structure 2 has the extended use life, the conventional mechanical key structure 2 is still not satisfactory to the users of the electronic sports games. The use of the mechanical key structure can provide the depressing feedback. Moreover, the users are interested in the immersive fun. For example, after the shooting operation, the key structure of the keyboard generates vibration. The vibration of the key structure provides a sense of presence about the shooting backlash. In other words, there is a need of providing a keyboard with a vibration function in order to press close to the simulated reality experience of electronic sports games.

SUMMARY OF THE INVENTION

The present invention provides a keyboard with a vibration function.

In accordance with an aspect of the present invention, a keyboard with a vibration function is provided. The keyboard includes a base member, an upper cover, a basic key structure and a vibration key structure. The base member is covered by the upper cover. The upper cover includes a hollow portion. The basic key structure is installed on the base member and partially exposed outside the upper cover. When the basic key structure is depressed, a basic key signal is generated. The vibration key structure is disposed within the hollow portion and partially exposed outside the upper cover. When the vibration key structure is depressed, a vibration key signal is generated and a vibration action is provided. The vibration key structure includes a control module, a vibration keycap and an isolation element. The control module is fixed on the upper cover and partially penetrated through the hollow portion. When the control module is triggered, the vibration key signal is generated and the vibration action is provided. The control module is covered by the vibration keycap. The vibration keycap is exposed outside the upper cover. The isolation element is arranged between the control module and the upper cover. The vibration key structure is enclosed by the isolation element, so that the energy of the vibration action from the control module is isolated.

In accordance with another aspect of the present invention, a keyboard with a vibration function is provided. The keyboard includes a base member, an upper cover, a basic key structure and a vibration key structure. The base member is covered by the upper cover. The upper cover includes a hollow portion. The basic key structure is installed on the base member and partially exposed outside the upper cover. When the basic key structure is depressed, a basic key signal is generated. The basic key structure includes a first circuit board, a first mechanical key switch and a basic keycap. The first circuit board is installed on the base member. The first mechanical key switch is installed on the first circuit board and partially exposed outside the upper cover. The first mechanical key switch is covered by the basic keycap. The basic keycap is exposed outside the upper cover. When the first mechanical key switch is depressed, the basic key signal is generated. The vibration key structure is disposed within the hollow portion and partially exposed outside the upper cover. When the vibration key structure is depressed, a vibration key signal is generated and a vibration action is provided. The vibration key structure includes a bottom plate, a second circuit board, a second mechanical key switch, a vibration element, a fixing frame and a vibration keycap. The bottom plate is installed on the base member. The second circuit board is installed on the bottom plate. The second mechanical key switch is installed on the second circuit board and partially penetrated through the hollow portion. When the second mechanical key switch is depressed, the vibration key signal is generated. The vibration element is installed on the second circuit board. When the second mechanical key switch generates the vibration key signal, the vibration element provides the vibration action corresponding to the vibration key signal. The second circuit board and the bottom plate are sheltered by the fixing frame. The second circuit board is fixed on the bottom plate and the second circuit board and the bottom plate are fixed on the upper cover by the fixing frame. The second mechanical key switch is covered by the vibration keycap. The vibration keycap is exposed outside the upper cover.

From the above descriptions, the present invention provides a keyboard with a vibration function. The key structures of the keyboard are classified into vibration key structures and non-vibration key structures (i.e., the basic key structures). Moreover, the isolation element is arranged between the vibration key structures and the basic key structures. Consequently, the vibration effect of the vibration key structures will not be scattered, and the fun of playing the electronic sports game can be enhanced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
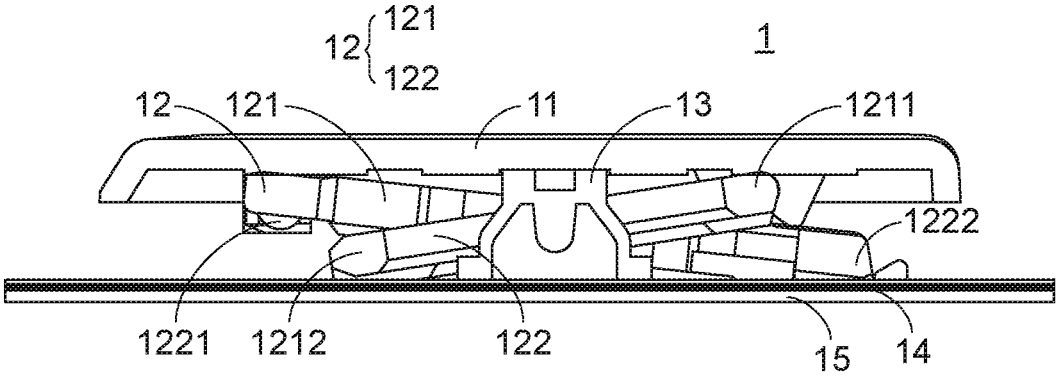
FIG.1 PRIOR ART
FIG. 1 is a schematic side cross-sectional view illustrating a conventional key structure.
Figure 2:
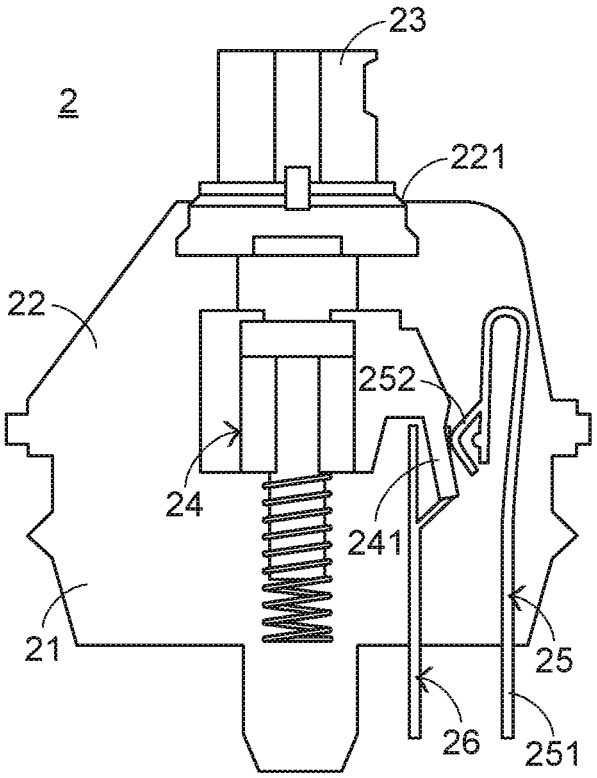
FIG.2 PRIOR ART
FIG. 2 is a schematic side cross-sectional view illustrating a conventional mechanical key structure.

For solving the drawbacks of the conventional technologies, the present invention provides a keyboard with a vibration function. The embodiments of present invention will be described more specifically with reference to the following drawings. For well understanding the present invention, the elements shown in the drawings are not in scale with the elements of the practical product. In the following embodiments and drawings, the elements irrelevant to the concepts of the present invention or the elements well known to those skilled in the art are omitted. It is noted that numerous modifications and alterations may be made while retaining the teachings of the invention.

Figure 3:
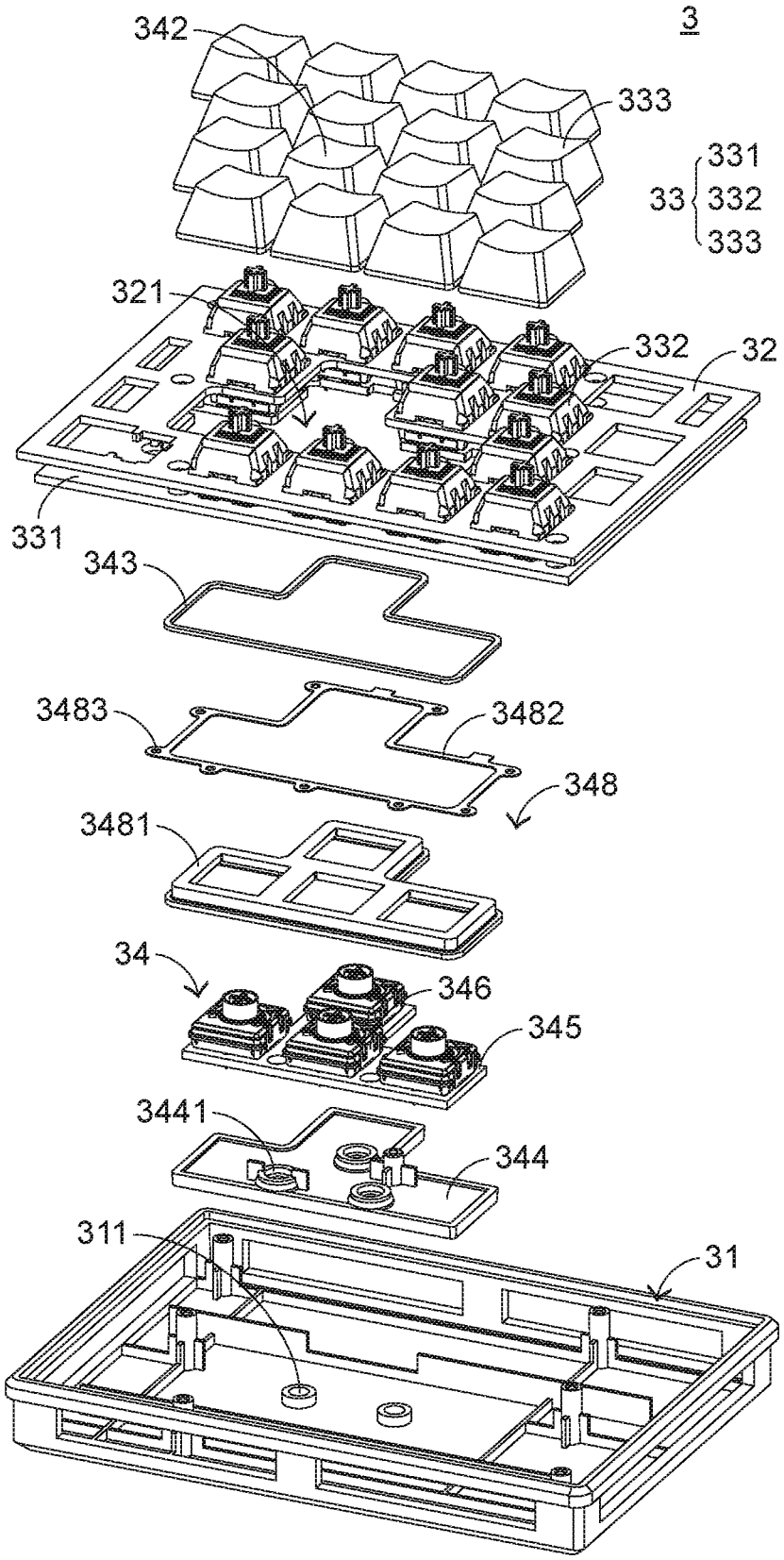
FIG. 3 is a schematic exploded view illustrating a portion of a keyboard with a vibration function according to an embodiment of the present invention.
Figure 4:
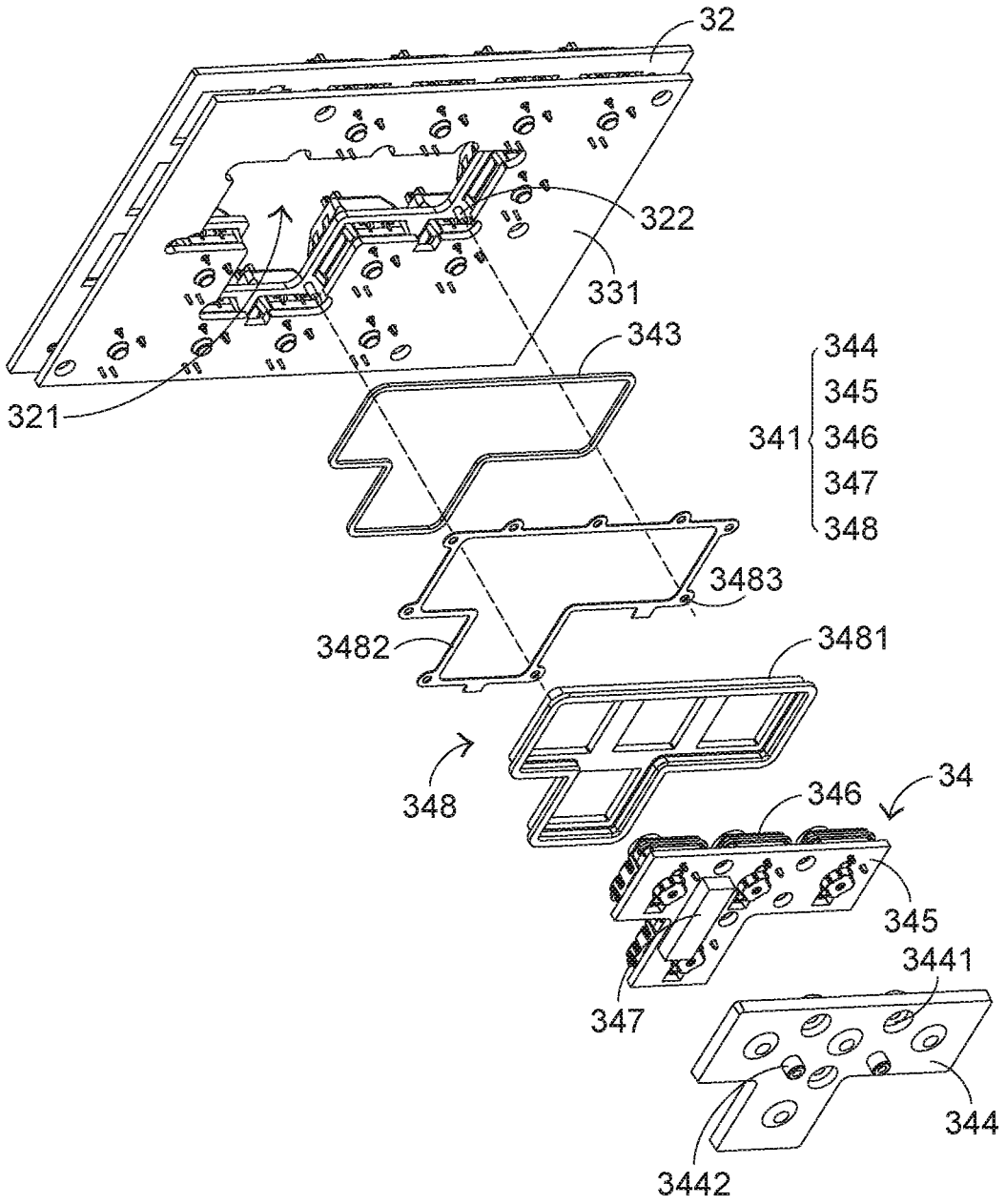
FIG. 4 is a schematic exploded view illustrating a portion of the keyboard according to the embodiment of the present invention and taken along another viewpoint.
Figure 5:
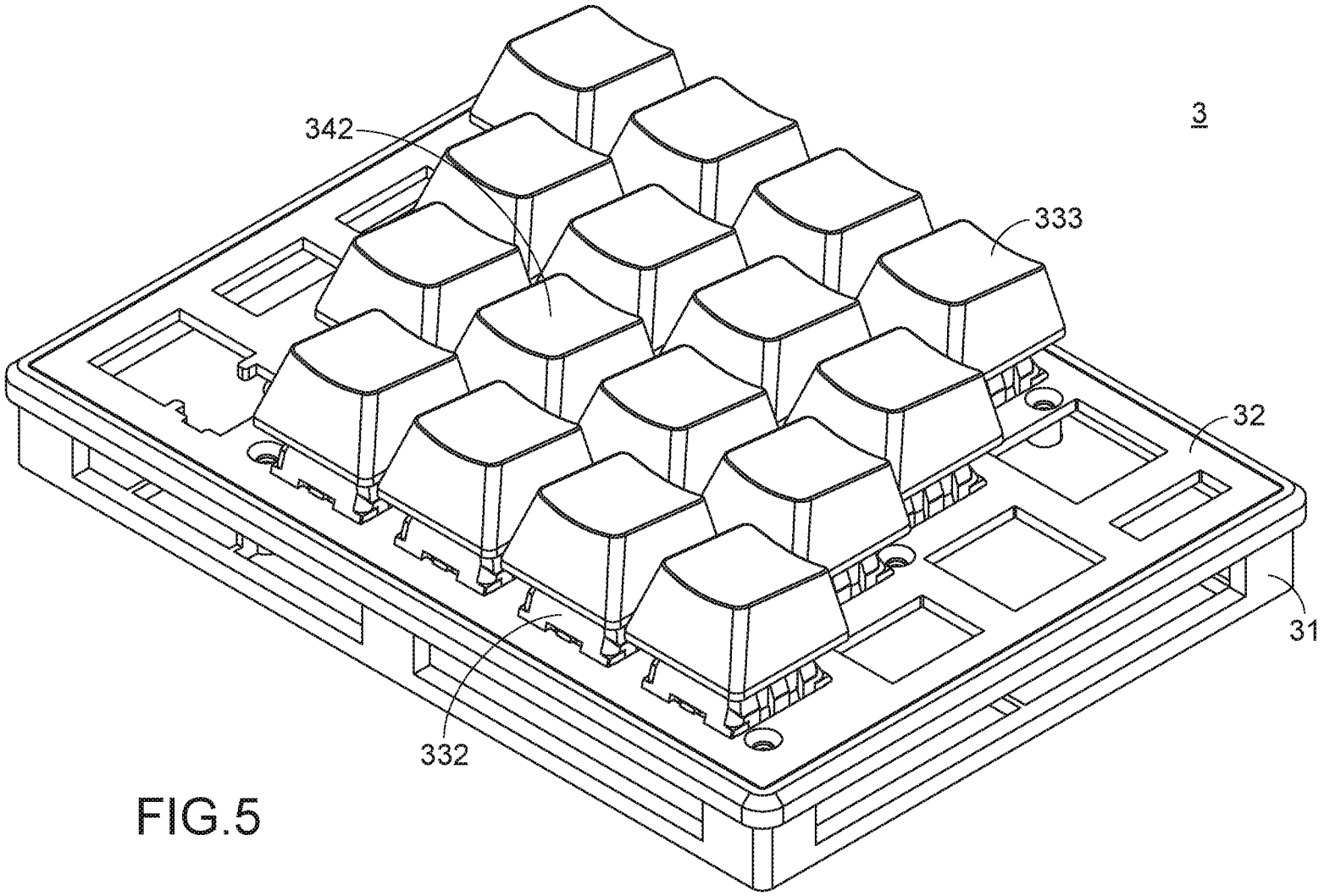
FIG. 5 is a schematic perspective view illustrating a portion of the keyboard according to the embodiment of the present invention.

The structure of the keyboard of the present invention will be described as follows. Please refer to FIGS. 3, 4 and 5. FIG. 3 is a schematic exploded view illustrating a portion of a keyboard with a vibration function according to an embodiment of the present invention. FIG. 4 is a schematic exploded view illustrating a portion of the keyboard according to the embodiment of the present invention and taken along another viewpoint. FIG. 5 is a schematic perspective view illustrating a portion of the keyboard according to the embodiment of the present invention. The keyboard 3 comprises a base member 31, an upper cover 32, plural basic key structures 33 and plural vibration key structures 34. In an embodiment, the number of the plural vibration key structures 34 is 4. For example, the four vibration key structures 34 include the W key, the A key, the S key and the D key. The base member 31 is covered by the upper cover 32. The upper cover 32 has a hollow portion 321. The plural basic key structures 33 are installed on the base member 31 and partially exposed outside the upper cover 32. When one of the plural basic key structures 33 is depressed by the user, a corresponding basic key signal is generated. Each basic key structure 33 comprises a portion of a first circuit board 331, a first mechanical key switch 332 and a basic keycap 333. The first mechanical key switch 332 is installed on the first circuit board 331 and partially exposed outside the upper cover 32. When the first mechanical key switch 332 is depressed, the corresponding basic key signal is generated. The inner structure of the first mechanical key switch 332 is similar to those of the conventional mechanical key structure 2, and is not redundantly described herein. The basic keycap 333 is placed over the first mechanical key switch 332 to cover the first mechanical key switch 332. Moreover, the basic keycap 333 is exposed outside the upper cover 32 so as to be depressed by the user.

Figure 6:
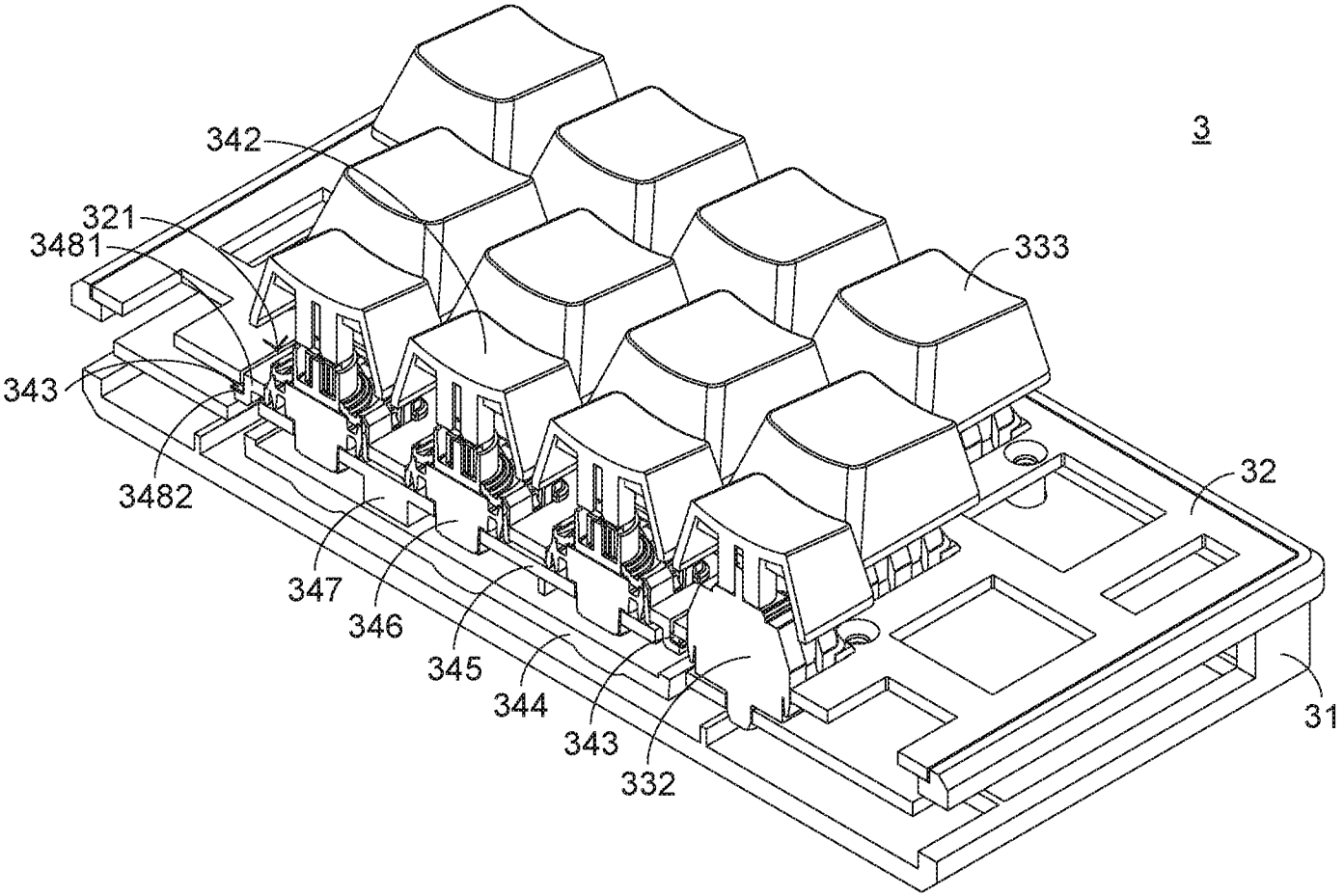
FIG. 6 is a schematic cutaway view illustrating a portion of the keyboard according to the embodiment of the present invention.

Please refer to FIGS. 3, 4, 5 and 6. FIG. 6 is a schematic cutaway view illustrating a portion of the keyboard according to the embodiment of the present invention. The plural vibration key structures 34 are disposed within the hollow portion 321 and partially exposed outside the upper cover 32. When one of the plural vibration key structures 34 is depressed, a corresponding vibration key signal is generated and a vibration action is provided. The vibration action provides the feel of the depressing feedback to the user.

Hereinafter, a single vibration key structure 34 will be taken as an example for illustration. The vibration key structure 34 comprises a control module 341, a vibration keycap 342 and an isolation element 343. The control module 341 is fixed on the upper cover 32 and partially penetrated through the hollow portion 321. When the control module 341 is triggered, the corresponding vibration key signal is generated and the vibration action is provided. The vibration keycap 342 is placed over the control module 341 to cover the control module 341. Moreover, the vibration keycap 342 is exposed outside the vibration keycap 342. While the vibration keycap 342 is depressed by the user, the vibration keycap 342 is correspondingly moved to trigger the control module 341. The isolation element 343 is arranged between the control module 341 and the upper cover 32 to enclose the plural vibration key structures 34 (e.g., four vibration key structures 34 of this embodiment). The isolation element 343 is used for isolating the vibration from the control module 341. Consequently, the vibration energy is not transferred to the plural basic key structures 33. In other words, the vibration force sensed by the user will not be scattered. Preferably but not exclusively, the isolation element 343 is a sponge structure or a rubbery ring.

In an embodiment, the control module 341 comprises a bottom plate 344, a second circuit board 345, plural second mechanical key switches 346, a vibration element 347 and a fixing frame 348. The bottom plate 344 comprises plural fastening holes 3441 and plural support posts 3442. The plural support posts 3442 are disposed on a bottom surface of the bottom plate 344. The base member 31 comprises plural supporting grooves 311. The plural support posts 3442 are inserted into the corresponding supporting grooves 311. Consequently, the bottom plate 344 is installed on the base member 31. After screws are penetrated through the corresponding fastening holes 3441 of the bottom plate 344 and tightened into the second circuit board 345, the bottom plate 344 is combined with the second circuit board 345. Consequently, the bottom plate 344 is fixed on the base member 31, and the second circuit board 345 is installed on the bottom plate 344. The connecting relationships between the bottom plate 344, the second circuit board 345 and the base member 31 and the structures of the associated components are not restricted.

Moreover, the shapes of the bottom plate 344 and the second circuit board 345 match a T-shaped combination structure of the W key, the A key, the S key and the D key. The plural second mechanical key switches 346 are installed on a top surface of the second circuit board 345 and partially penetrated through the hollow portion 321. When one of the plural second mechanical key switches 346 is depressed, the corresponding vibration key signal is generated. In this embodiment, the number of the plural second mechanical key switches 346 is 4, and the number of the plural vibration key structures 34 is 4. Moreover, the four second mechanical key switches 346 and the four vibration key structures 34 are aligned with the mechanical key switches of the W key, the A key, the S key and the D key, respectively. It is noted that the number of the second mechanical key switches and the number of the vibration key structures are not restricted. Moreover, the keys to be aligned with the second mechanical key switches and the vibration key structures are not restricted to the W key, the A key, the S key and the D key.

The vibration element 347 is installed on a bottom surface of the second circuit board 345. When the second mechanical key switch 346 generates the vibration key signal, the vibration element 347 provides a vibration action corresponding to the vibration key signal. The fixing frame 348 is used for sheltering the second circuit board 345 and the bottom plate 344. Moreover, the fixing frame 348 can fix the second circuit board 345 on the bottom plate 344 and fix the control module 341 on the upper cover 32. The isolation element 343 is sheathed around the fixing frame 348 and arranged between the control module 341 and the upper cover 32. In an embodiment, the vibration element 347 is a vibrator, and the shape of the fixing frame 348 matches the T-shaped combination structure of the W key, the A key, the S key and the D key.

In an embodiment, the fixing frame 348 comprises a covering body 3481 and a fixing ring 3482. The second circuit board 345 and the bottom plate 344 are sheltered by the covering body 3481. The fixing ring 3482 is fixed on the covering body 3481 and contacted with the upper cover 32. The fixing ring 3482 comprises plural first fixing parts 3483.

The plural first fixing parts 3483 are externally extended from the fixing ring 3482. The upper cover 32 comprises plural second fixing parts 322. The plural second fixing parts 322 are aligned with the corresponding first fixing parts 3483, respectively. The plural second fixing parts 322 are disposed on a bottom surface of the upper cover 32. When the plural second fixing parts 322 are aligned with the corresponding first fixing parts 3483 and combined with the corresponding first fixing parts 3483, the fixing frame 348 is fixed on the upper cover 32 and the plural second mechanical key switches 346 are partially penetrated through the hollow portion 321.

In an embodiment, the fixing ring 3482 is fixed on the covering body 3481 through an adhesive. Moreover, the isolation element 343 is arranged between the fixing ring 3482 and the upper cover 32. By the isolation element 343, the vibration energy is stopped from being transferred to the upper cover 32 or the plural basic key structures 33. In an embodiment, the first fixing parts 3483 are fixing holes, and the second fixing parts 322 are fixing posts corresponding to the fixing holes. When the fixing posts are penetrated through the corresponding fixing holes, the fixing frame 348 is fixed on the upper cover 32. It is noted that the types of the first fixing parts and the second fixing parts are not restricted. For example, in another embodiment, the fixing frame comprises plural fixing posts and the upper cover comprises the corresponding fixing holes.

In an embodiment, the covering body 3481 is made of plastic material, and the fixing ring 3482 is made of metallic material. Since the covering body 3481 is made of plastic material, the fabricating cost of the keyboard 3 is reduced.

It is noted that numerous modifications and alterations may be made while retaining the teachings of the invention. For example, the fixing frame comprises plural first fixing parts, and the plural first fixing parts are externally extended from the fixing frame. In addition, the upper cover comprises plural second fixing parts, and the plural second fixing parts are disposed on the bottom surface of the upper cover. The plural second fixing parts are aligned with the corresponding first fixing parts and combined with the corresponding first fixing parts. Consequently, the fixing frame is fixed on the upper cover, and the plural second mechanical key switches are partially penetrated through the hollow portion.

In other words, the fixing ring is extended externally from the outer periphery of the covering body, and the fixing ring is integrally formed with the covering body. For preventing from abrasion of the fixing ring in response to the vibration of the upper cover, the fixing ring and the upper cover are made of metallic material. Consequently, the structural strength of the keyboard is enhanced.

After the above components are assembled with each other, the keyboard 3 with the vibration function is manufactured. The structure of the keyboard 3 and the connecting relationships between these components can be seen in FIGS. 5 and 6. As shown in FIG. 6, the isolation element 343 is arranged between the fixing ring 3482 and the upper cover 32, and the plural vibration key structures 34 are enclosed by the isolation element 343. Consequently, the vibration energy generated by the vibration element 347 can be applied to the plural second mechanical key switches 346 only. That is, the vibration energy will not be transferred to the basic key structures 33. In such way, the vibration effect of the vibration key structure 34 will not be scattered. Especially, all of the key switches of the keyboard 3 are mechanical key switches, and the components of the mechanical key switches are firmly fixed in the keyboard 3. Consequently, the components of the mechanical key switches are not shifted in response to the vibration.

From the above descriptions, the present invention provides a keyboard with a vibration function. The key structures of the keyboard are classified into vibration key structures and non-vibration key structures (i.e., the basic key structures). Moreover, the isolation element is arranged between the vibration key structures and the basic key structures. Consequently, the vibration effect of the vibration key structures will not be scattered, and the fun of playing the electronic sports game can be enhanced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard with a vibration function, the keyboard comprising:

a base member;

an upper cover, wherein the base member is covered by the upper cover, and the upper cover comprises a hollow portion;

a basic key structure installed on the base member and partially exposed outside the upper cover, wherein when the basic key structure is depressed, a basic key signal is generated; and a vibration key structure disposed within the hollow portion and partially exposed outside the upper cover, wherein when the vibration key structure is depressed, a vibration key signal is generated and a vibration action is provided, wherein the vibration key structure comprises:

a control module fixed on the upper cover and partially penetrated through the hollow portion, wherein when the control module is triggered, the vibration key signal is generated and the vibration action is provided;

a vibration keycap, wherein the control module is covered by the vibration keycap, and the vibration keycap is exposed outside the upper cover; and an isolation element arranged between the control module and the upper cover, wherein the vibration key structure is enclosed by the isolation element, so that an energy of the vibration action from the control module is isolated.

2. The keyboard according to claim 1, wherein the basic key structure comprises:

a first circuit board installed on the base member;

a first mechanical key switch installed on the first circuit board and partially exposed outside the upper cover, wherein when the first mechanical key switch is depressed, the basic key signal is generated; and a basic keycap, wherein the first mechanical key switch is covered by the basic keycap, and the basic keycap is exposed outside the upper cover.

3. The keyboard according to claim 1, wherein the control module comprises:

a bottom plate installed on the base member;

a second circuit board installed on the bottom plate;

a second mechanical key switch installed on the second circuit board and partially penetrated through the hollow portion, wherein when the second mechanical key switch is depressed, the vibration key signal is generated;

a vibration element installed on the second circuit board, wherein when the second mechanical key switch generates the vibration key signal, the vibration element provides the corresponding vibration action; and a fixing frame, wherein the second circuit board and the bottom plate are sheltered by the fixing frame, and the second circuit board is fixed on the bottom plate and the control module is fixed on the upper cover by the fixing frame, wherein the isolation element is sheathed around the fixing frame and arranged between the control module and the upper cover.

4. The keyboard according to claim 3, wherein the fixing frame comprises plural first fixing parts, and the plural first fixing parts are externally extended from the fixing frame, wherein the upper cover comprises plural second fixing parts, and the plural second fixing parts are aligned with corresponding first fixing parts, respectively, wherein when the plural second fixing parts are combined with the corresponding first fixing parts, the fixing frame is fixed on the upper cover and the second mechanical key switch is partially penetrated through the hollow portion.

5. The keyboard according to claim 3, wherein the fixing frame comprises:

a covering body, wherein the second circuit board and the bottom plate are sheltered by the covering body; and a fixing ring fixed on the covering body and contacted with the upper cover, wherein the fixing ring comprises plural first fixing parts, and the plural first fixing parts are externally extended from the fixing ring, wherein the upper cover comprises plural second fixing parts, and the plural second fixing parts are aligned with the corresponding first fixing parts, respectively, wherein when the plural second fixing parts are combined with the corresponding first fixing parts, the fixing frame is fixed on the upper cover and the second mechanical key switch is partially penetrated through the hollow portion, wherein the fixing ring is fixed on the covering body via an adhesive, and the isolation element is arranged between the fixing ring and the upper cover.

6. The keyboard according to claim 5, wherein the covering body is made of plastic material, and the fixing ring is made of metallic material.

7. A keyboard with a vibration function, the keyboard comprising:

a base member;

an upper cover, wherein the base member is covered by the upper cover, and the upper cover comprises a hollow portion;

a basic key structure installed on the base member and partially exposed outside the upper cover, wherein when the basic key structure is depressed, a basic key signal is generated, wherein the basic key structure comprises a first circuit board, a first mechanical key switch and a basic keycap, wherein the first circuit board is installed on the base member, the first mechanical key switch is installed on the first circuit board and partially exposed outside the upper cover, the first mechanical key switch is covered by the basic keycap, and the basic keycap is exposed outside the upper cover, wherein when the first mechanical key switch is depressed, the basic key signal is generated; and a vibration key structure disposed within the hollow portion and partially exposed outside the upper cover, wherein when the vibration key structure is depressed, a vibration key signal is generated and a vibration action is provided, wherein the vibration key structure comprises:

a bottom plate installed on the base member;

a second circuit board installed on the bottom plate;

a second mechanical key switch installed on the second circuit board and partially penetrated through the hollow portion, wherein when the second mechanical key switch is depressed, the vibration key signal is generated;

a vibration element installed on the second circuit board, wherein when the second mechanical key switch generates the vibration key signal, the vibration element provides the corresponding vibration action;

a fixing frame, wherein the second circuit board and the bottom plate are sheltered by the fixing frame, and the second circuit board is fixed on the bottom plate and the second circuit board and the bottom plate are fixed on the upper cover by the fixing frame; and a vibration keycap, wherein the second mechanical key switch is covered by the vibration keycap, and the vibration keycap is exposed outside the upper cover.

8. The keyboard according to claim 7, wherein the vibration key structure further comprises an isolation element, and the isolation element is arranged between the fixing frame and the upper cover, wherein the vibration key structure is enclosed by the isolation element, so that the energy of the vibration action from the control module is isolated.

9. The keyboard according to claim 7, wherein the fixing frame comprises plural first fixing parts, and the plural first fixing parts are externally extended from the fixing frame, wherein the upper cover comprises plural second fixing parts, and the plural second fixing parts are aligned with corresponding first fixing parts, respectively, wherein when the plural second fixing parts are combined with the corresponding first fixing parts, the fixing frame is fixed on the upper cover and the second mechanical key switch is partially penetrated through the hollow portion.

10. The keyboard according to claim 7, wherein the fixing frame comprises:

a covering body, wherein the second circuit board and the bottom plate are sheltered by the covering body; and a fixing ring fixed on the covering body and contacted with the upper cover, wherein the fixing ring comprises plural first fixing parts, and the plural first fixing parts are externally extended from the fixing ring, wherein the upper cover comprises plural second fixing parts, and the plural second fixing parts are aligned with the corresponding first fixing parts, respectively, wherein when the plural second fixing parts are combined with the corresponding first fixing parts, the fixing frame is fixed on the upper cover and the second mechanical key switch is partially penetrated through the hollow portion, wherein the fixing ring is fixed on the covering body via an adhesive, and the isolation element is arranged between the fixing ring and the upper cover.

* * * * *